US006325306B1

(12) United States Patent
Gacanich et al.

(10) Patent No.: US 6,325,306 B1
(45) Date of Patent: Dec. 4, 2001

(54) VARIABLE SIZE REDUCTION APPARATUS AND PROCESS

(75) Inventors: Jeanne M. Gacanich, Socorro; Moises E. Romero, Lemitar; Fabian M. Romero, Jr., Socorro; Yu Ping Tang; Edward C. Hensel, both of Las Cruces, all of NM (US)

(73) Assignees: Material Recovery of North America, Inc., Las Cruces; Southwest Tire Processors, Socorro, both of NM (US)

( * ) Notice: Subject to any disclaimer, the term of this patent is extended or adjusted under 35 U.S.C. 154(b) by 0 days.

(21) Appl. No.: 09/177,338

(22) Filed: Oct. 22, 1998

Related U.S. Application Data

(60) Provisional application No. 60/063,003, filed on Oct. 22, 1997.

(51) Int. Cl.[7] ..... B02C 13/18

(52) U.S. Cl. ..... 241/15; 241/27; 241/29; 241/65; 241/188.1

(58) Field of Search ..... 241/15, 27, 29, 241/47, 186.35, 188.1, 162, 65, 34

(56) References Cited

U.S. PATENT DOCUMENTS

| | | | |
|---|---|---|---|
| 1,636,033 | 7/1927 | Agnew . | |
| 1,653,472 | 12/1927 | Scherbaum . | |
| 1,669,239 | 5/1928 | Grindle . | |
| 1,758,010 | 5/1930 | Pettinos . | |
| 1,798,465 | 3/1931 | Grindle . | |
| 2,211,518 | 8/1940 | Scherbaum . | |
| 2,359,911 | 10/1944 | Grindle . | |
| 2,609,995 | 9/1952 | Klagsbrunn . | |
| 3,260,468 | 7/1966 | Beard . | |
| 3,448,932 | 6/1969 | Prohl . | |
| 3,851,829 | 12/1974 | Dopper et al. . | |
| 3,987,970 | 10/1976 | Burkett . | |
| 4,029,263 | 6/1977 | Wilkinson et al. . | |
| 4,133,487 | 1/1979 | Lanier . | |
| 4,151,794 | 5/1979 | Burkett . | |
| 4,383,650 | 5/1983 | Contal et al. . | |
| 4,469,284 | 9/1984 | Brubaker et al. . | |
| 4,614,310 | 9/1986 | Tloczynski et al. . | |
| 4,637,561 | 1/1987 | Edberg . | |
| 4,690,338 * | 9/1987 | Sayler et al. | 241/56 |
| 4,747,550 | 5/1988 | Jackering . | |
| 4,757,949 | 7/1988 | Horton . | |
| 4,919,347 | 4/1990 | Kamiwano et al. . | |
| 5,257,742 | 11/1993 | Yashima et al. . | |
| 5,373,996 | 12/1994 | Hamada . | |
| 5,522,559 | 6/1996 | Bredbeck . | |
| 5,577,675 | 11/1996 | Ishikawa . | |
| 5,732,894 * | 3/1998 | Sheahan | 241/56 |

OTHER PUBLICATIONS

Gordienko, N.A., et al., "Development of Equipment for Pulverizing Used Polymer Materials" *New Machines and Equipment*, vol. 20, No. 3–4 pp 163–166 (Mar.–Apr. 1984).
*Scrap tire News*, Dec. 1996, vol. 10, No. 12.

* cited by examiner

*Primary Examiner*—John M. Husar
(74) *Attorney, Agent, or Firm*—Deborah A. Peacock; Andrea L. Mays

(57) ABSTRACT

A size reduction apparatus and process for reducing the size of a heterogeneous or homogeneous article or articles using variable and interchangeable interior parts for varying article output size and an air handling system for introducing air and/or fluid into the process of size-reduction. The components of a heterogeneous article are separated and used to aid in the size-reduction process.

40 Claims, 12 Drawing Sheets

VARIABLE SIZE REDUCTION APPARATUS AND PROCESS

CROSS-REFERENCE TO RELATED APPLICATIONS

This application claims the benefit of the filing of U.S. Provisional Patent Application Ser. No. 60/063,003, entitled "Design of a Tire Pulverizer," to Gacanich, et al., filed on Oct. 22, 1997, and the specification thereof is incorporated herein by reference.

BACKGROUND OF THE INVENTION

1. Field of the Invention (Technical Field)

The present invention relates to a rotary-driven recycling apparatus that reduces the article input size of tire chip and various other materials to a desired article output size.

2. Background Art

Today many materials such as worn rubber tires are recycled for resale on the market. Interest in tire recycling is relatively new. Serious attempts to recycle tires beyond using them for planters, door mats, and loading dock bumpers progressed very slowly until the mid-1980's. Even today tire-recycling processes are in the early stages of development, with the most dramatic progress taking place in the period since 1994. The first step in tire recycling is to take a whole scrap tire, and shred it into smaller chunks of material with fiber and steel interstitial to the rubber. In many cases, the shredded tire material, or "chip", is mono-filled into landfills, stockpiled again, burned as tire derived fuel, or used as a feed stock in further processing. Further processing is often referred to as crumbing, wherein either whole scrap tires or tire chip is fed into a processing unit, and is reduced to a variety of mesh sizes for use in various products. Typical industry standard crumbing equipment requires a ½" to ¾" tire chip input size in order to protect the crumbing equipment from excessive wear from the steel and fabric components in used tires.

Rubber crumb is a valuable source of raw material for new tires for automobiles, pavement for roads, playground surfaces, landscape materials, construction materials, shoes, etc. as well as for the extraction, petrochemical and petroleum-refining industries. Various sizes of rubber crumb can be sold on the market. As interest in recycling continues to grow, other materials—both heterogeneous and homogeneous—will be reduced to be used as raw material in the production of a multitude of goods.

The following is a discussion of present crumbing technologies and their limitations:

Cracker Mill Crumbing

Cracker mills reduce ½" to ¾" inch rubber input size into a finer rubber output size by compressing the rubber to its shattering point. In most crumbing operations there are several cracker mills in succession to achieve a 10-mesh output size. Although the cost per unit is moderate, the need for several units becomes cost intensive. Several problems exist with this technology. These mills often operate at very high temperatures—as high as 400° C. At around 250° C., the chemical and structural integrity of rubber begins to diminish, and vulcanization and ash and carbon black contamination occurs. The heat generated by this process also creates a fire hazard. Furthermore, companies that produce crumb rubber in this manner cannot easily interrupt their system of mills to screen off different output sizes. Internal parts are often welded together and difficult to access locking them into a limited product line because just one size of output material is produced. Furthermore, mills of this type simply cut the article and do not separate the different materials, which make up the article, for example, the steel or cord, rubber, and fibrous matter which make up rubber tires.

Cryogenic Crumbing Technology

In cryogenic crumbing technology, scrap tires are frozen by introducing liquid nitrogen or other cryogenic fluid to them in a hermetically sealed canister causing the rubber to become brittle. The frozen rubber is then reduced by standard equipment to cause the separation of three components, rubber, steel, and fiber. In order for this system to produce large quantities of crumb rubber, the tires have to be shredded prior to freezing, and the crumbing throughput is directly related to the size of the tire chip coming out of the shredder. Cryogenic freezing is used to obtain a finer output size with less wear on standard equipment. However, this process adds an additional and costly energy-intensive step to standard systems. Furthermore, the effect of the cryogenic temperature on the thermophysical and chemical properties of the rubber makes it unsuitable for some applications.

Pyrolysis

Pyrolysis is an anaerobic process that can be used to convert scrap tires into their underlying constituent products, which include a mixture of carbon blacks and byproducts including ash, zinc oxides, carbonates, and silicates (collectively referred to as char and comprising approximately 37% by weight), pyrolytic oil (comparable to Number Six fuel oil), gas, and steel. Much of the gas is commonly used as an energy source to drive the chemical reaction, which takes place in a refinery-like apparatus. Pyrolysis typically requires a multi-million dollar capital investment, and the economic viability of products based on this technology has not yet been demonstrated in the marketplace.

Buffing

When a waste tire is taken to a recapping shop to have a replacement tread installed, the old tread is buffed off from the casing. The buffings produced in this manner are generally considered to be of high quality and small mesh size. However, these buffings tend to be geometrically elongated in one direction making them unappealing for some applications.

Machines performing the various crumbing processes are typically quite large, have high electrical power consumption, high incidence of replacement parts, low efficiency, high maintenance costs, high running temperatures, overheating or cryogenic embrittlement of the rubber, and poor operating convenience. Rotors are often jammed when the chunk load rate is increased to a point exceeding the maximum torque capability of the drive system causing an immediate increase in the electric current driving the machine and a potential for drive system failure. Furthermore, rubber, which has lost its chemical structural integrity due to high operating temperatures, must be treated with chemical additives resulting in tremendous expense. And, in order to obtain the desired rubber output size, several passes through the machine are necessary.

Patents disclosing shredders, grinders, and mills quite different from the present invention include: U.S. Pat. No. 4,151,794 to Burkett, entitled "Apparatus for Treating Organic Materials"; U.S. Pat. No. 3,987,970 to Burkett, entitled "Centrifugal Mill"; U.S. Pat. No. 4,637,561 to Edberg, entitled "Beater Mill Having at Least One Vertically or Obliquely Extending Cylindrical Milling Chamber"; U.S. Pat. No. 4,469,284 to Brubaker et al., entitled "Comminuting Apparatus With Improved Rotor and Stator Recess Construction"; U.S. Pat. No. 4,614,310 to Tloczynski et al., entitled "Comminuting Apparatus with Fluid Cylinder Rotor and Stator Biasing"; U.S. Pat. No. 2,359,911 to Grindle, entitled "Pulverizer"; U.S. Pat. No. 1,758,010 to Pettinos, entitled "Grinding Mill"; U.S. Pat. No. 5,577,675 to Ishikawa, entitled "Agitating Pulverizer"; U.S. Pat. No. 5,522,559 to Bredbeck, entitled "Rubber Crumbing Apparatus"; U.S. Pat. No. 4,747,550 to Jackering, entitled "Grinding Mill with Multiple Milling Sections"; U.S. Pat. No. 3,851,829 to Dopper et al., entitled "Device for Crushing Solid Materials"; U.S. Pat. No. 1,636,033 to Agnew, entitled "Centrifugal Impact Pulverizer"; U.S. Pat. No. 4,133,487 to Lanier, entitled "Method and Apparatus for Comminuting Solid Article in a Fluid Stream"; U.S. Pat. No. 5,373,996 to Hamada, entitled "Granular Material Processing Apparatus"; U.S. Pat. No. 5,257,742 to Yashima et al., entitled "Ultrafine Grinding Mill of Which Fed Material Flows Down Through an Agitated Bed Composed of Small Grinding Medium"; U.S. Pat. No. 4,919,347 to Kamiwano et al., entitled "Dispersing and Grinding Apparatus"; U.S. Pat. No. 4,383,650 to Contal et al., entitled "Method and Apparatus for Grinding Rubber"; U.S. Pat. No. 2,211,518 to Scherbaum, entitled "Grinding Mill"; U.S. Pat. No. 3,448,932 to Prohl, entitled "Waste Disposal Devices"; U.S. Pat. No. 3,260,468 to Beard, entitled "Grinding Mill and Blower Combination"; U.S. Pat. No. 2,609,995 to Klagsbrunn, entitled "Centrifugal Mill"; U.S. Pat. No. 1,798,465 to Grindle, entitled "Coal Mill"; U.S. Pat. No. 1,669,239 to Grindle, entitled "Pulverizer"; U.S. Pat. No. 4,757,949 to Horton, entitled "Apparatus for Shredding Rubber Tires"; U.S. Pat. No. 4,029,263 to Wilkinson et al., entitled "Ballistic Pulveriser Separator"; and U.S. Pat. No. 1,653,472 to Scherbaum, entitled "Pulverizing or Grinding Mill." None of these patents disclose removably attachable and interchangeable interior configurations, the ability to produce variable output sizes, unique air flow systems, feedback control systems, or unique size-reduction techniques which impact the article to be reduced and utilize the heterogeneity of the article to further aid in size-reduction.

SUMMARY OF THE INVENTION

Disclosure of the Invention

The present invention is of a variable size reduction apparatus and process. The apparatus comprises a housing; a rotary drive mechanism; removably attached and interchangeable rotors with removably attached and interchangeable knives and impactors mounted on them; a center drive shaft within the housing for rotating the rotors; removable and variably sized center shaft cover rings to space the rotors; a coolant jacket surrounding the housing; a removable and interchangeable liner within the housing with cutting surfaces; and a fluid handling system. The center shaft, rotors, and cover rings comprise an integral removable spindle assembly unit. The impactors propel the article and the knives and liner cut the article. In the preferred embodiment, the impactors have angular sides and ends, and the rotors have varying diameters with chamfered edges. In the preferred embodiment, the fluid handling system additionally comprises gas or liquid flow control with fluid inlets and outlets, valves, fans, fluid input devices, and holes through the rotors. The apparatus additionally comprises a feedback feeding rate control mechanism to control an article input mechanism. The process propels the article within the housing of the apparatus thereby causing contact with surfaces within the housing. The article is then cut and compressed upon contact causing any harder components in the article to eject and separate from softer components. Then these harder components additionally cut the article. The apparatus outputs varying sizes and shapes of the input article and maintains a desired temperature of the article with just one pass through the apparatus due to the variability of the interior parts.

A primary object of the present invention is to be easily adjustable to accommodate a desired article output size.

Another object of the present invention is to be able to separate the components of a heterogeneous article.

Still another object of the present invention is to be able to control the operating temperature such hat the integrity of the article is not compromised.

Another object of the present invention is to be able to accommodate a variety of article input sizes and types.

Yet another object of the present invention is to be easily accessible to maintenance, repair, and adjustability.

A primary advantage of the present invention is the ability to produce a wide range of article output sizes and shapes with just one pass through the apparatus.

Another advantage of the present invention is its low operating temperature.

Yet another advantage of the present invention is the ability to accept a variety of heterogeneous as well as homogeneous articles.

Other advantages of the present invention are increased productive capacity, increased efficiency, decreased jamming, decreased maintenance, improved maintenance convenience, improved operating convenience, improved operator safety, and smaller overall dimensions.

Other objects, advantages and novel features, and further scope of applicability of the present invention will be set forth in part in the detailed description to follow, taken in conjunction with the accompanying drawings, and will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

Best Mode for Carrying Out the Invention

The present invention is an apparatus and method for the size reduction of various article types and article input sizes to a desired article output size, thereby enabling the recycling of materials. The term "article" in singular form will be used henceforth in this description, but shall be taken to also refer to articles in plural form.

Figure 7:
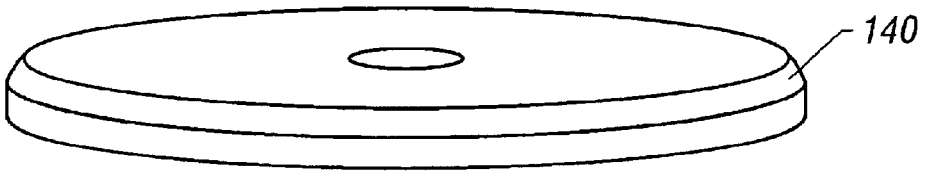
FIG. 7 is a perspective view of a platform edge of FIG. 1.
Figure 8:
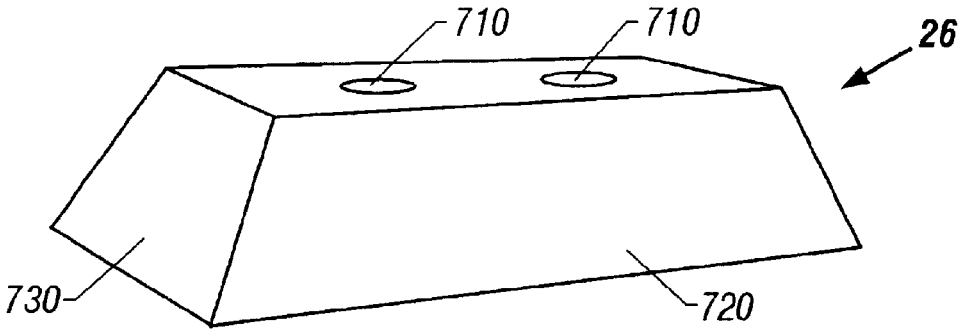
FIG. 8 is a perspective view of an impactor of FIG. 1.
Figure 9:
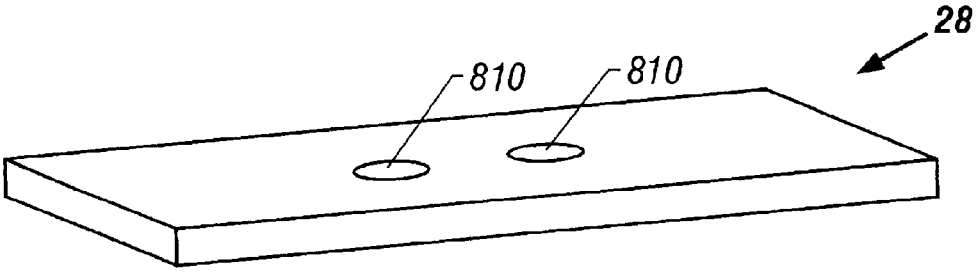
FIG. 9 is a perspective view of a knife of FIG. 1.
Figure 10:
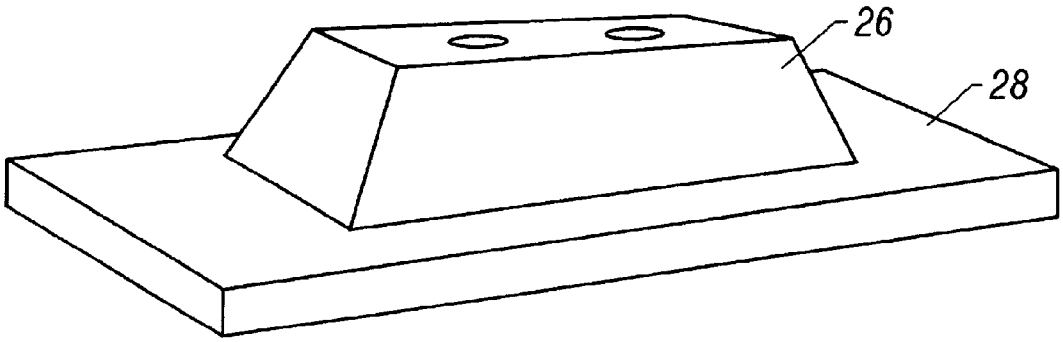
FIG. 10 is a perspective view of a knife and impactor combination of FIG. 1.

FIGS. 1–18 illustrate the preferred apparatus 10 of the present invention and its operation. Article 80 to be reduced is fed by hand or by uniform or variable feed-rate conveyor 72 into vertical inlet chute 12. From there, gravity and or air flow move article 80 through inlet chute 12 to first stage 14. In first stage 14, horizontally planar first rotor 20 rotates around center shaft 42. In first stage 14 of the apparatus, knives 28 are mounted directly onto the top surface of rotor 20 and impactors 26 are mounted directly on top of knives 28. Impactor 26 is shown in FIG. 8 and knife 28 is shown in FIG. 9. Combination knife 28 and impactor 26 is shown in FIG. 10. When article 80 contacts impactors 26, article 80 is propelled about stage 14 at a desired angle due to the unique shape of impactors 26. Article 80 then strikes itself and liner 58 that is vertically and coaxially located within the apparatus. Article 80 is also briefly trapped between rotor 20 and liner 58 and is cut by knives 28. Liner 58 has liner chambers 450 (see FIG. 5) which further cut article 80 upon contact and also provide traction for trapping article 80. If, for example, the article to be reduced is rubber tire containing metal cord, or any other heterogeneous article made up of two or more materials of varying degrees of hardness, then the pieces of cord are expelled from the rubber during the compression of the rubber while contacting the liner and impactors. While rubber compresses when it strikes a surface, the much harder cord within the rubber does not. Therefore, the cord is expelled from the rubber and further shears the rubber during expulsion. The expelled cord then further aids in cutting the rubber during the reducing process. Once article 80 is reduced to a size sufficiently small to pass through clearance space 30 between rotor 20 and liner 58 of first stage 14, it falls into second stage 16.

Further size reduction occurs in second stage 16 in the same manner as in first stage 14. Once the article is reduced to a size sufficiently small to pass through the clearance space between second rotor 22 and liner 58, it falls into third or final stage 18. Still further size reduction occurs in third stage in the same manner as in first and second stages 14 and 16. As the article proceeds through each successive stage it is reduced into successively smaller bits. Once the article is reduced to a size sufficient to pass through the clearance space between third rotor 24 and liner 58 of third stage 18 H exits through exit port 32 (partially shown). The rotor diameters increase from top to bottom thereby decreasing the clearance between the rotor edges and liner 58 from top to bottom. Thus, only increasingly smaller sizes of the article can exit from any given stage. Only three stages are described herein, however, the apparatus is designed to accommodate as many stages as necessary to produce the desired article output size with just one pass through the apparatus.

Motor or other rotary drive device 34 rotates center shaft 42 in either a clockwise or counterclockwise direction with belts 40 and drive sheaves 36 and 38. Rotors 20, 22, and 24 are mounted onto center shaft 42 by hubs 48 and are thus rotated by center shaft 42. Center shaft 42 has keyway 44 and key detents 46 to which both center shaft cover rings 50 and hubs 48 are adjustably and removably attached with mating keyways. Cover rings 50 are of various vertical lengths and are used as spacers to space rotors 20, 22, and 24 vertically apart by predetermined distances. Cover rings 50 also protect shaft 42 from wear. Cover rings 50 and hubs 48 can be aligned with setscrews to key detents 46 at whatever spacing is necessary to achieve the desired number of cutting stages and vertical stage height, creating a highly flexible interior. Cover rings 50 further protect the interior of the apparatus from damage because they maintain the rotors in position should the rotors break free from the center shaft during operation. With the cover rings in place, the rotors cannot move up or down vertically within the apparatus even if they break free of the shaft during rotation and therefore will not strike other surfaces inside the apparatus.

Figure 3:
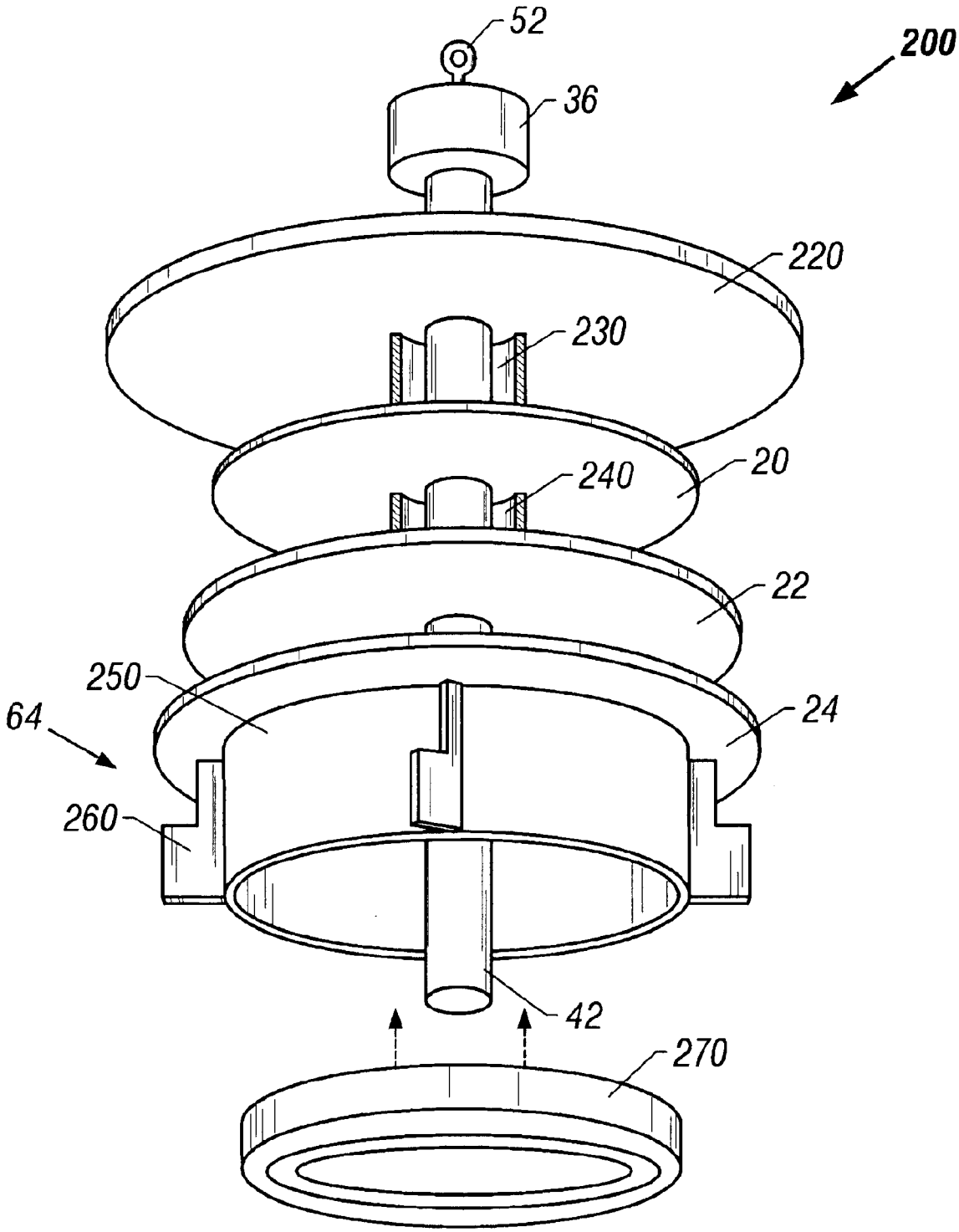
FIG. 3 is a perspective view of the spindle assembly of FIG. 1.

Furthermore, center shaft 42, drive sheave 36, top cover 220 (see FIG. 3), rotors 20, 22, and 24, all implements attached to the rotors, shaft cover rings 50, and hubs 48 together form removable spindle assembly 200 (see FIG. 3). Once cover bolts 54 and 56 are removed, then entire spindle assembly 200 can be lifted out of the apparatus by lifting eye-hook 52. This allows for rapid maintenance, repair, and interchangeability of rotors, knives, and impactors. Rotors, impactors, and knives can be added or subtracted, or they can be re-configured upon spindle assembly 200. Alternatively, the spindle assembly could be "swapped" with another pre-configured spindle assembly for minimal "down-time."

Figure 11:
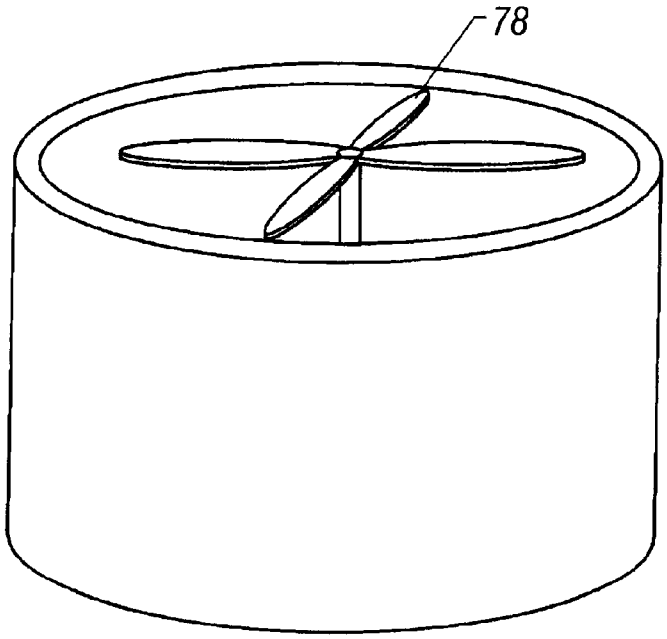
FIG. 11 is a perspective view of an axial vane fan of FIG. 1.

Air flow and pressure is maintained throughout the stages by air entering the apparatus through air inlets 66 and 68. Air travels downward through the apparatus in the same direction as the article through air holes 120 (see FIG. 2) in first and second rotors 20 and 22 and through the clearance between all rotor peripheral edges and liner 58. The rotation of spindle assembly 200 and fan 64 in combination pull the air through the apparatus to cool, control pressure distribution throughout the stages, maintain article flow and distribution throughout the stages, and control the retention time of the article in the apparatus. Air exits with the article through exit port 34. Fan 64 is more clearly shown in FIG. 3. Horizontal butterfly valves 74 and 76 are configured with air inlets 66 and 68 respectively to further control air flow into the apparatus. Optional chemical input 70 to air inlets 66 and 68 creates further flexibility because chemicals or other substances can be fed into the apparatus this way to aid in processing the article. FIG. 11 shows optional axial vane fan 78 operating in conjunction with the air inlets to increase air flow to the apparatus.

The purpose of the inlet vents is to provide sufficient cross sectional area for the suction of ambient air into the apparatus. Vanes, dampers, or other flow control devices such as those shown may be used with the inlet vents to restrict or increase the amount of air allowed to enter the apparatus cavity. Further, each rotor may have none, one, or a plurality of openings in the rotor to allow air to flow either less or more readily through the apparatus. Air is drawn in through the inlet vents, passes through the rotor openings, and between the rotor outer radius and the liner inner radius, and downward through the apparatus. The air is drawn downward by the fan which, in the preferred embodiment, is attached to the bottom of the lowest rotor. An optional article guard may be attached as a stator to the apparatus base, internal to (at a slightly smaller diameter than) the fan housing. The article guard reduces potential pathways for effluent below the apparatus and increases the fan suction available. Alternative embodiments of the air handling system include an air motive device external to the outlet of the apparatus, or external to the inlet vents of the apparatus. A screen can optionally be placed in any or all of air holes 120 in the rotors to allow the passage of air but inhibit the passage of the article through them.

The air handling system provides convective cooling to the article being reduced and to the apparatus itself and inhibits the backward flow of dust, particles, or other contaminants through the apparatus. When used to reduce the size of rubber tire chunks, the present invention operates at a temperature between 30° C. and 130° C. thereby maintaining the quality and elasticity of the rubber and lowering internal wear of the apparatus. Additionally, the air entering the apparatus can be cooled before entering the apparatus, thereby further increasing the cooling effect of the air.

Balancing, or intentionally not balancing, the size of the openings at each vertical level (e.g. the air holes in each rotor and clearance between the rotors and liner) of the apparatus allows the apparatus to be tuned to a variety of loading conditions. For example, by reducing the openings in the rotor, the residence time of the article being reduced in the apparatus can be increased. By increasing the opening areas in the rotors, the residence time can be decreased. This balancing can be performed independently on each rotor. For example, the bottom rotor typically has no air flow openings. This insures the final article output size at the exit plane, stops the article from exiting the bottom of the apparatus, rather than through the exit plane, and increases residence time at the lowest stage.

The air handling system also provides downward momentum to the article being reduced, to improve contact between the downward-flowing article and the rotors, impactors, and knives. Increasing the air-flow sufficiently allows the apparatus to be operated in any configuration or orientation, and reduces the dependency of the apparatus on gravity. The air handling system also reduces the interior pressure of the apparatus slightly below ambient barometric pressure, to facilitate size-reduction of any article that may be hazardous to operators. In this way, upstream and downstream additions to the apparatus insures that no harmful materials (such as vapors) exit into the workspace.

The air inlets may be used to introduce chemicals or other additives, as discussed above, into the article as it is being reduced. For example, a chemical denaturant is aspirated (or otherwise introduced) into the inlet air stream (or inlet fluid, gaseous or liquid) via a pipe or hose as shown, or other mechanism, and that additive is dispersed throughout the article as it is being reduced. In this manner, both size-reduction and chemical processing of the article are achieved concurrently. For example, if a chemical treatment is used (e.g., to perform devulcanization or even just surface activation of rubber) then the present invention can perform this process, size-reduction of the article, and the constituent separation of the article concurrently.

Additional cooling may be achieved by passing coolant fluid around the apparatus through a cylindrical coolant jacket. Water or other desired liquid coolant enters through fluid inlet 60 and passes through the coolant jacket to cool the apparatus. The interior of the coolant jacket is designed to facilitate a serpentine path of the coolant through the jacket, in a general direction counter-flow (upward) to the motion of the article (downward) through the apparatus. Heated coolant is expelled through fluid outlet 62.

Figure 1:
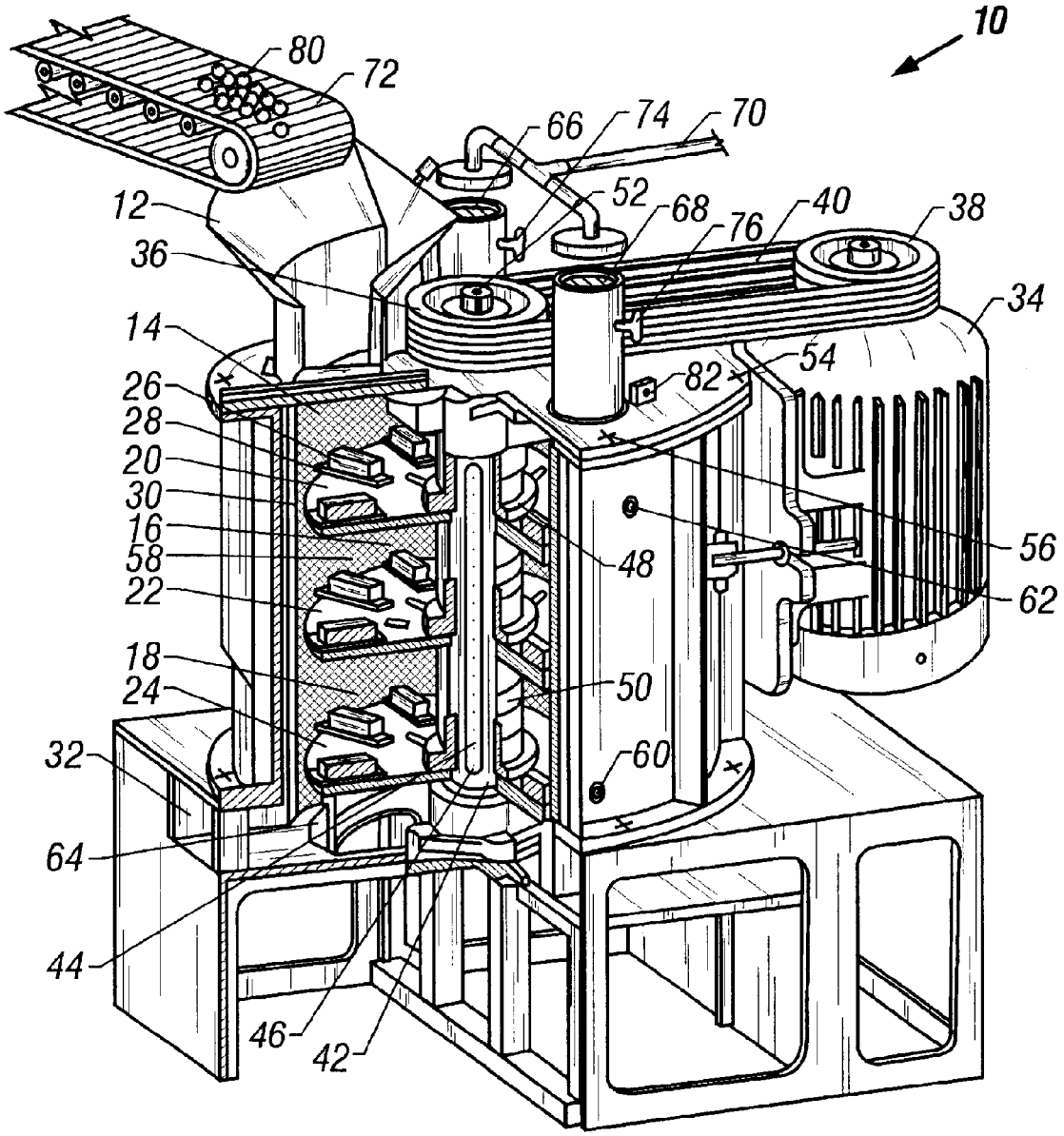
FIG. 1 is a perspective view of the preferred embodiment of the invention.
Figure 2:
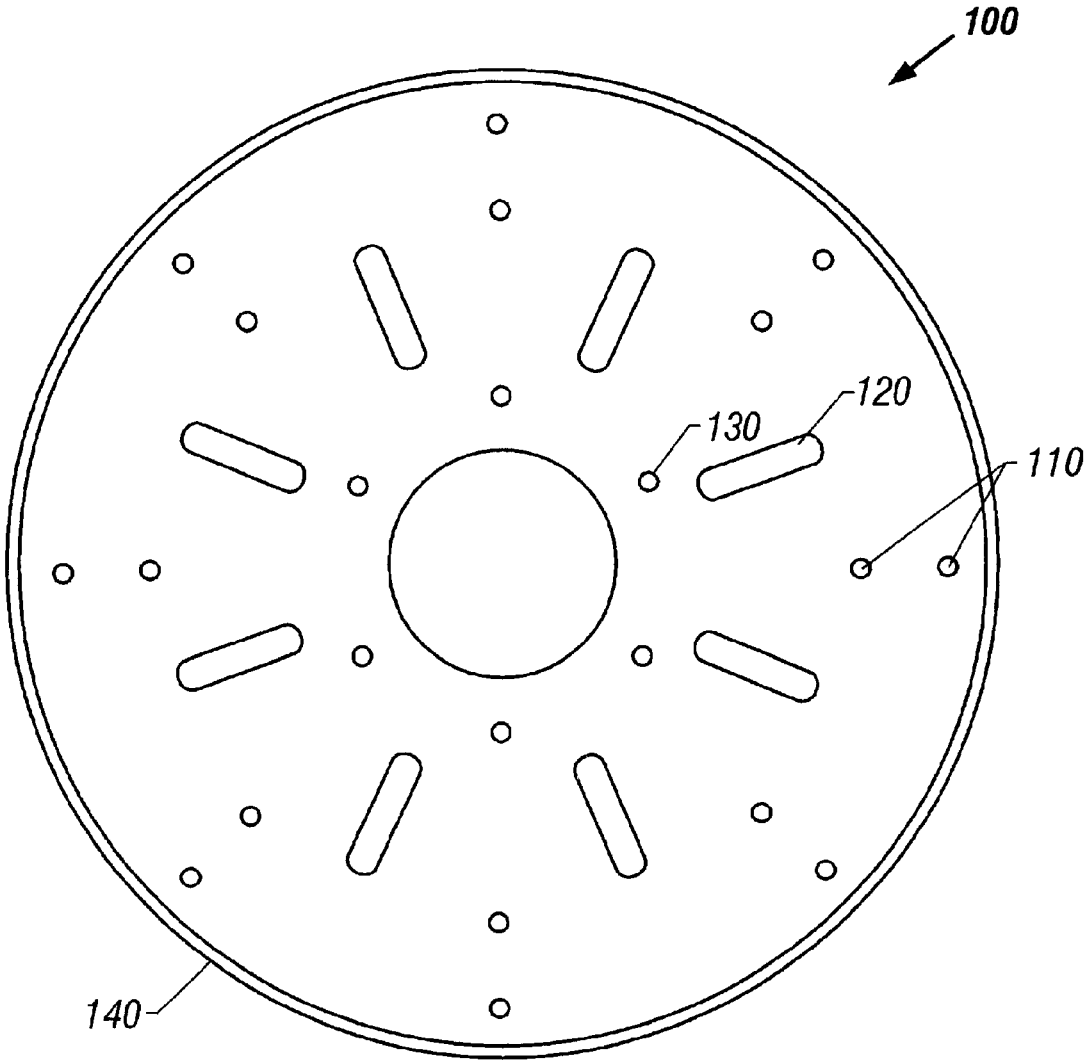
FIG. 2 is a top-view of an upper platform of FIG. 1.

FIG. 2 shows a top-view of upper rotor 100, which can be either the first or second rotor in the preferred embodiment. Bolt holes 110 are provided to attach the removable knives 28 and removable impactors 26 to rotor 100. Knives 28 can be operated in a clockwise or counterclockwise rotation, easily unbolted and interchanged or replaced, rotated end-to-end, or turned up-side down to wear each potential cutting surface of knives 28. Impactors 26, which are removably attached to knives 28, can also be unbolted and interchanged or replaced, or rotated end-to-end to wear each impact surface. Bolt holes 130 are provided to attach the hub. Air holes 120 are provided for the convection of air throughout the apparatus as described above. Chamfered edge 140 allows for easier passage of the article through the clearance between the rotor edge and liner 58. FIG. 7 better demonstrates the chamfering that is optionally on all rotor edges 140. The chamfering is shown as the rotor top surface diameter being smaller than the rotor bottom surface diameter. However, the diameter relationships can be reversed.

FIG. 3 shows removable integral spindle assembly 200. Lifting eye-hook 52, drive sheave 36, top cover 220, first, second, and third rotors 20, 22, and 24, center shaft 42, and various sizes of center shaft cover rings 230 and 240 (perspective views), are shown as part of spindle assembly 200. Cover rings 230 and 240 can be of various sizes and demonstrate the ability to space rotors 20, 22, and 24 at differing vertical distances from one another. Rotors 20, 22, and 24 are shown with increasing diameters from top to bottom to provide the different clearances between the rotor peripheral edges and liner. Note that the rotors are shown without impactors or knives, to demonstrate that the apparatus can be adapted for use as a simple grinding machine for traditional homogeneous materials if desired. Spindle assembly 200 also depicts fan 64 as fan housing 250 and fan blades 260 attached to the underside of third rotor 24. As third rotor 24 rotates, the corresponding rotation of the fan assembly pulls air through the apparatus as described above. The fan also aids in expelling the article out through the exit port. Optional article guard 270 can be placed coaxially within fan housing 250. While three rotors are depicted herein, the center shaft keyway, key detents, and center shaft cover rings allow for varying numbers of rotors and rotor configurations upon the spindle. The operator can adjust the spindle, knives, and impactors to accommodate the desired article output size as previously discussed.

Figure 4:
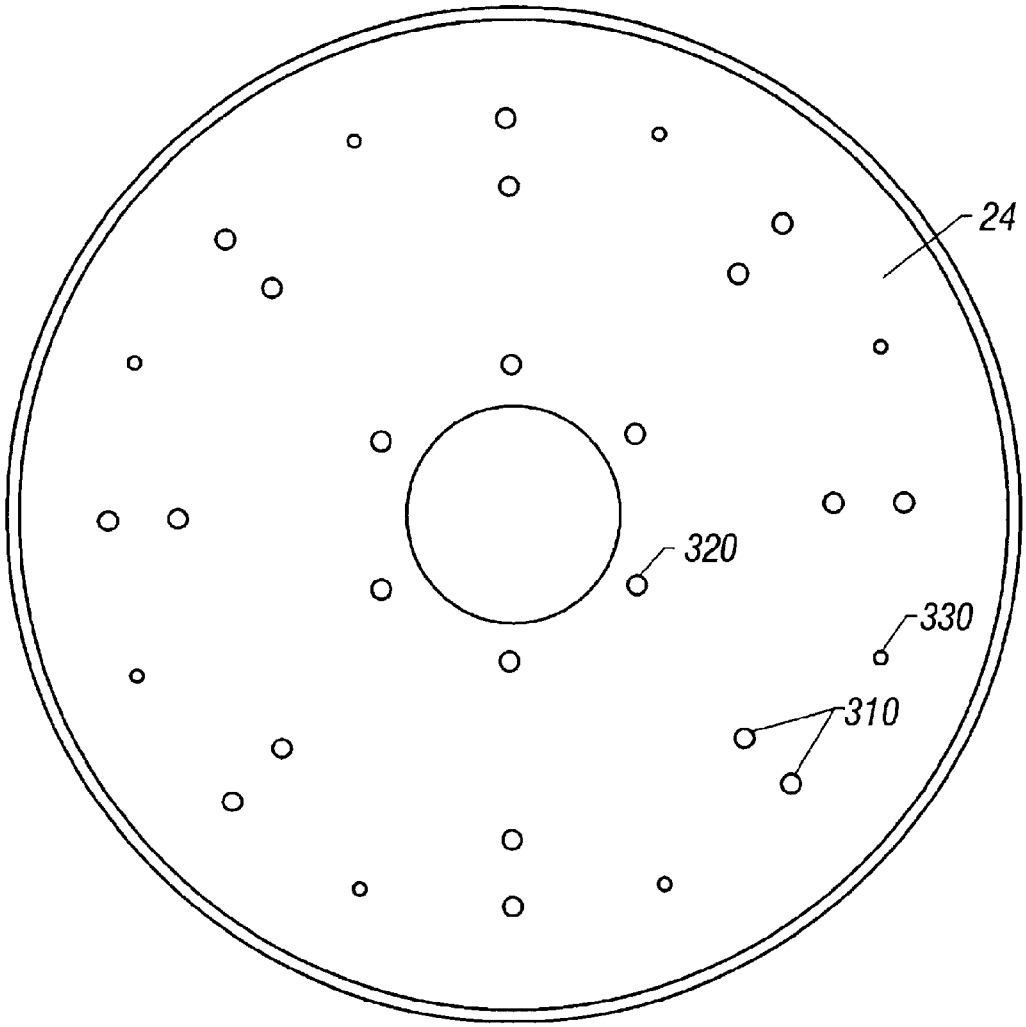
FIG. 4 is a top-view of the bottom platform of FIG. 1.

FIG. 4 is a top-view of third and lowest rotor 24. In the preferred embodiment this rotor does not contain air holes, but optionally can contain air holes. Bolt holes 310 are for attaching the removable knives as described in upper rotor configuration 100, and bolt holes 320 are for attaching the hub. Bolt holes 330 are for attaching removable fan housing 250 with fan blades 260 described above in FIG. 3.

Figure 5:
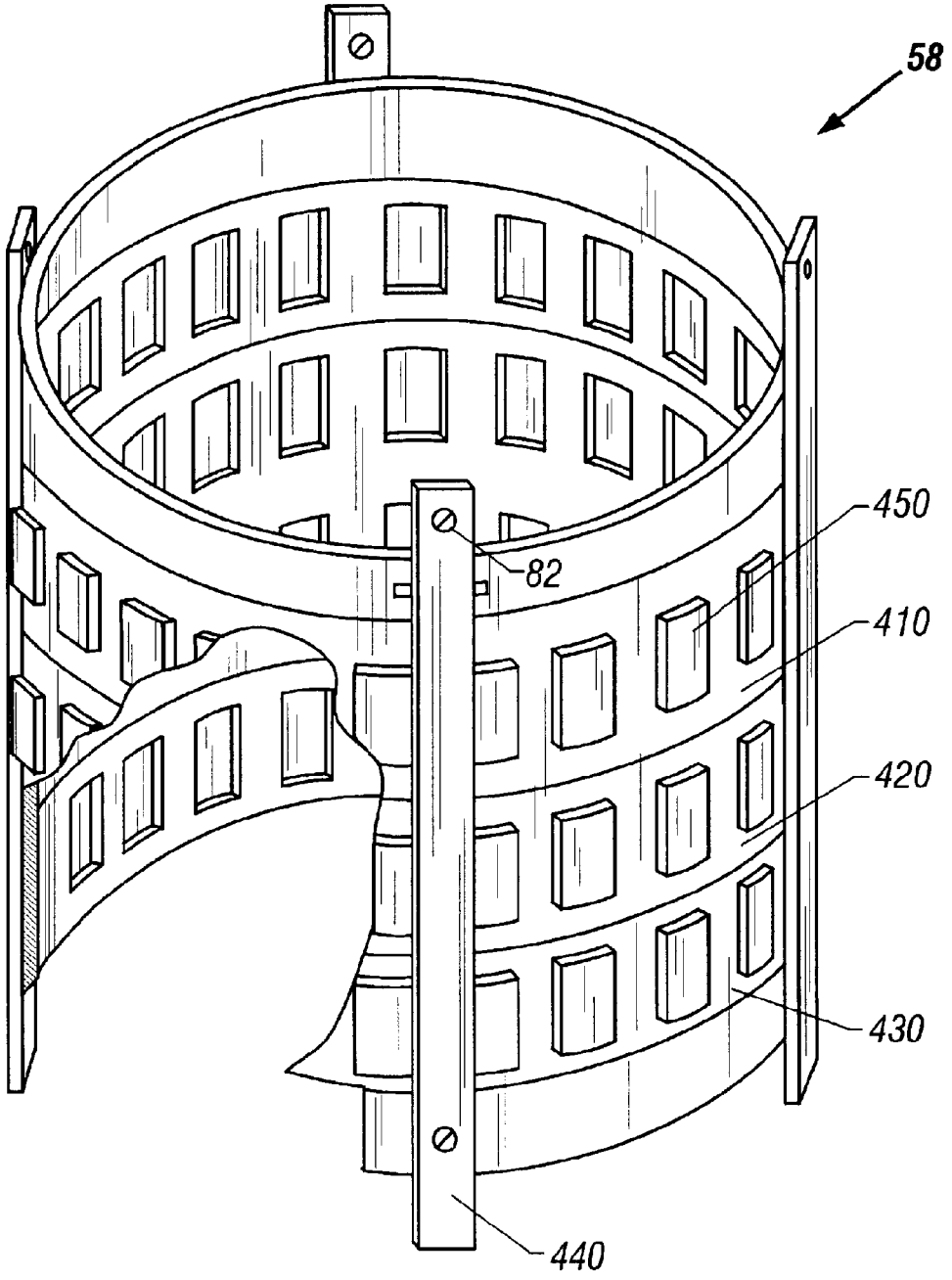
FIG. 5 is a perspective view of the liner of FIG. 1.

FIG. 5 depicts liner 58. Liner 58 is shown as three liner rings 410, 420, and 430. However, liner 58 can be made of any number of rings. The rings are connected to form an integral liner wall by four retainer tabs 440. Liner 58 is comprised of these rings so that they can be interchanged for even wear over the entire liner. For example, first liner ring 410 will wear out more quickly than third liner ring 430 due to the larger size of the article being reduced in the first stage of the apparatus. Therefore, these two liner rings can be exchanged after a certain amount of use to increase the overall life of the liner. Liner 58 can be easily lifted out through the top of the apparatus by connecting a lifting device to retainer tab holes 82 at the upper end of each retainer tab. When liner 58 is in use, retainer tabs 440 protrude through the upper and lower cover plates of the apparatus such that they are affixed and prohibit angular motion of liner 58. FIG. 5 also depicts liner chambers 450. These chambers are formed by removing portions of the liner, thus forming holes in the liner, then providing a rear enclosure to these holes by affixing the portion that was removed to the outermost surface of the liner behind the hole. This creates radially outward concave chambers when viewed from inside the space created by the cylindrical liner assembly. By adding liner chambers 450 to liner 58 the interior surface area of the liner is increased and additional cutting surfaces are provided. As shown, liner chambers 450 provide four cutting surfaces. Although shown as being rectangular, liner chambers 450 can be of any shape or dimension. Any number of these chambers and chamber configurations can be configured on any or all of the liner rings. Alternatively, the liner chambers can be configured as recessed radially inward to the interior space defined by the liner. The chambers also create additional traction to briefly trap and compress the article between rotor edge 140 and liner 58. Then knife 28 cuts the article while it is briefly trapped.

Figure 6:
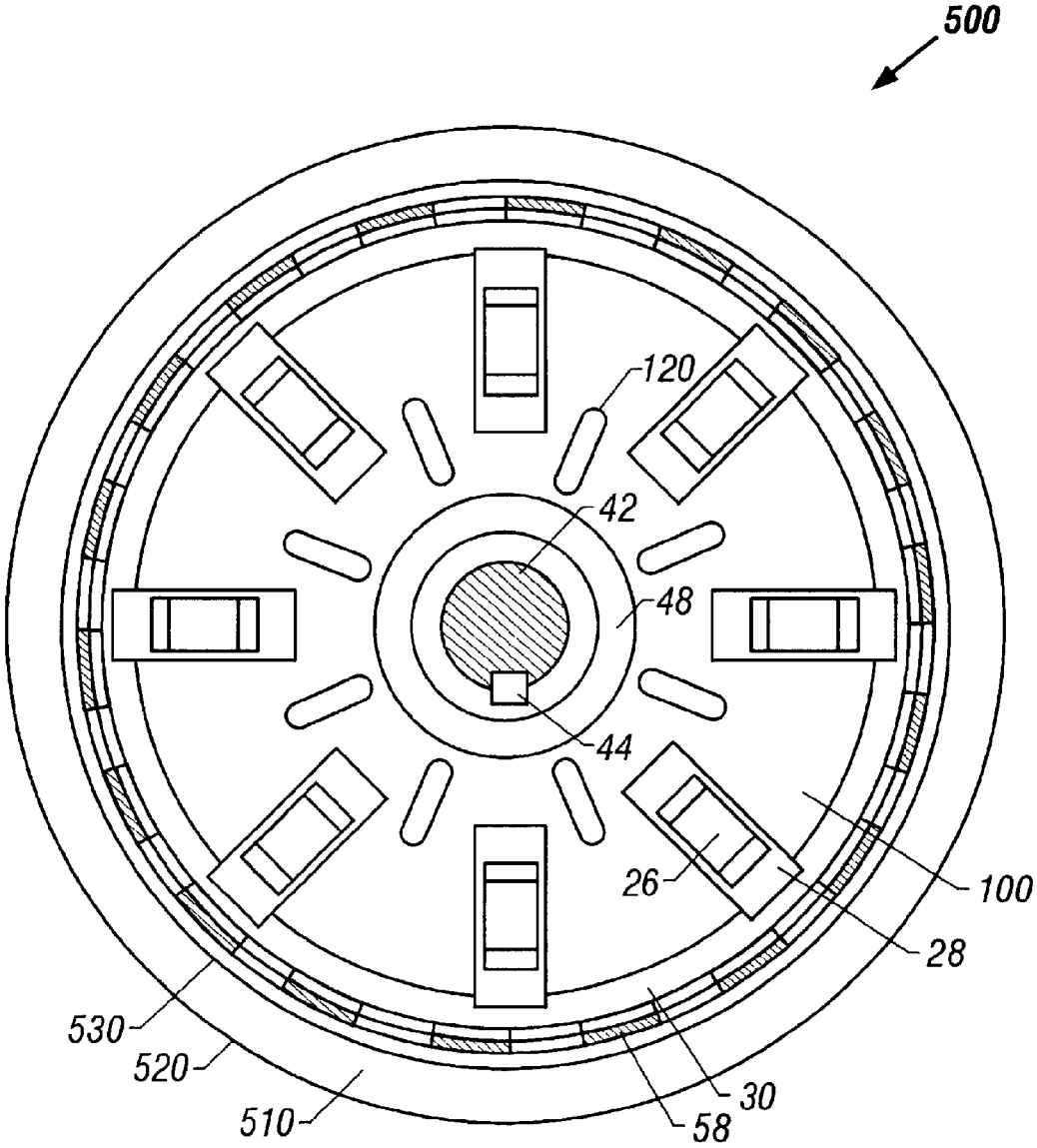
FIG. 6 is a top-view of an upper stage of FIG. 1.

FIG. 6 is a top-view of the apparatus looking down into an upper stage 500. Center shaft 42 and center shaft keyway 44 are shown surrounded by hub 48. The hub is attached to upper rotor 100. Air holes 120 are dispersed radially around the surface of rotor 100. Knives 28 with impactors 26 affixed to them are also disposed radially around the top surface peripheral edges of rotor 100. Knives 28 are substantially planar and placed to overhang the edge of rotor 100 to produce a cutting surface, which slices the article as rotor 100 rotates. Impactors 26 are placed on top of knives 28 in the preferred embodiment; however, they can be interspersed between the knives elsewhere on the top surface of rotor 100. Although eight air holes 120 and eight knife impactor combinations are shown, any number of air holes, knives, and impactors can be configured on rotor 100 or any other rotor. Clearance 30 is shown between the rotor peripheral edge and liner 58. Concentric walls 520 and 530 form the housing of the apparatus and within them is coolant jacket 510.

FIG. 8 shows impactor 26. Counter-sunk bolt holes 710 are provided for removably attaching impactor 26 to knife 28. Angular sides 720 and angular ends 730 demonstrate the unique configuration of impactor 26 in the preferred embodiment.

FIG. 9 shows knife 28. Bolt holes 810 are provided for removably attaching knife 28 to a rotor. FIG. 10 shows knife 28 and impactor 26 in the preferred combination.

Figure 12:
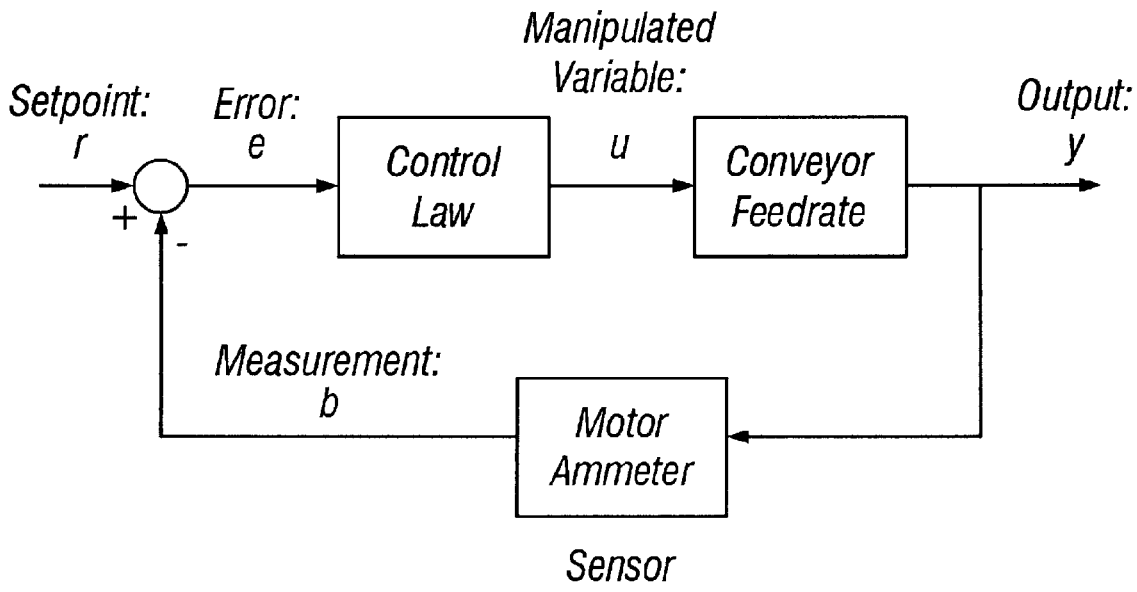
FIG. 12 is a block diagram of a feedback control system for use in the present invention.

FIG. 12 is a block diagram of a feedback control system for monitoring the motor amperage and providing a control signal back to the input conveyor. This system aids in reducing apparatus failure and limiting electrical utility demand charges to reduce operating costs. As the article density increases to a certain point in the apparatus, the motor has to increase its power output to continue the rotation of the center shaft. This can be measured by monitoring the current of the motor. Then, the feedrate of the conveyor, or other automated system is adjusted accordingly to lower, or raise, the article input rate.

In the preferred embodiment, the apparatus can be operated with as few as one rotor or multiple rotors (e.g., five or more rotors) depending upon the desired article input size, article output size, and throughput rate. In general, operation of the apparatus with fewer rotors produces an article output size predominantly ¼" and larger, while operation of the apparatus with more rotors is preferred for the production of fine article output sizes, such as 10 mesh to 80 mesh. The apparatus is capable of producing article output sizes as large as 1' and as small as −100 mesh with just one pass through the apparatus.

The rotors, impactors, knives, and liner are easily replaced when they exhibit wear. The apparatus can also be operated both in a clockwise and counter-clockwise direction allowing both the leading and trailing edges of wear surfaces, including liner chambers, impactors, knives, and rotors to be exposed to wear thus effectively doubling the lifetime of these components. In addition, the impactors and knives are designed to be symmetric in the radial direction as well as the circumferential direction. This line of symmetry increases the wear life on the impactors and knives by another factor of two. Thus, the wear surfaces on this apparatus have up to a 400% improvement over devices and technologies, which do not include this feature.

The axial position, and spacing, of the rotors on the center shaft is facilitated by a keyway on the center shaft, with a corresponding mating keyway on each rotor hub. Detents are provided on the center shaft key to facilitate proper axial positioning of the rotors at pre-determined positions on the shaft. Center shaft cover rings are provided in a set of various sizes to place axially between the top of one rotor hub, and the bottom of the next rotor.

The apparatus uses at least three physical processes to achieve size reduction and separation of the article into its distinct and separate, but co-mingled, constituents. These include (1) milling or shearing of the article, in a unique manner, (2) impaction and compression of the article such that stiffer constituents (such as the wire) are ejected from the article while the less stiff constituents (such as the rubber) are being compressed by impact against the liner wall, and (3) kinetic energy impact between the differing materials that provides size reduction much like a missile (bits of wire) striking a flying body (the rubber).

As a tire chip, or other heterogeneous article, enters the cavity of the apparatus, it falls downward. This downward motion may be induced by the action of gravity and or the air handling system. The article either falls onto, or is struck by, the rotating rotor. As the rotor moves, the impactors strike the article and impart momentum to the article. The direction of article motion induced by the impactors is influenced by the draft angle on the impactor surfaces and the relative velocity and relative angular acceleration of the impactors and the article. The magnitude of the article momentum is influenced by the angular speed and tangential speed of the rotor tip.

The liner is surfaced with features and angular surfaces shown as chambers in the preferred embodiment which include hardening and angles chosen specifically for the article type being reduced. The angles of the features of the liner may be chosen in concert with the angle of acceleration imparted by the impactors on the article to induce shearing along the critical planes of one or more of the constituent materials of the article being reduced. Hard-facing, or other surface treatments may be applied to the impactors, knives, and liner features to reduce wear. In the preferred embodiment of the invention, the liner features, and the impactors are treated to a surface hardness equal to or greater than the hardness of the hardest constituent of the article being reduced.

As the article strikes the liner, the more resilient constituent of the article (such as the rubber) tends to compress. As the article is compressed against the liner (and the harder material, steel, is being ejected from or shearing through the side of the article), the rotor continues its rotational motion. When the circumferential spacing of the knives upon the rotor is chosen properly in comparison to the angular velocity of the rotor and the compression time of the article, the knife surface strikes the article at or near its moment of maximum compression. During this interval of time, the article is easier to shear, or mill, than in its normal, relaxed state. This timing of impaction, self-shearing, and external milling by the knife blade all combine together to provide efficient size reduction and concurrent separation of the constituent materials of the article.

Other features characterize the unique aspects of the preferred embodiment of the apparatus. The apparatus is designed for extended wear-life, and the most expensive and sensitive components are protected from wear. For example, the center shaft cover rings not only space apart the rotors but also protect the shaft from wear. Several different alloys are used in the various components of the apparatus, which provide a long life-time of wear for the components. The knives are most preferably made of an extremely durable alloy, for example, grade #1060 steel. The impactors are most preferably made of Magnesium cast steel alloy, and the rotors can be made of a standard hard steel. The liner is preferably made of a mild steel to minimize shatter failure during size-reduction, and has hard-facing applied to the edges of the liner chambers.

The coolant jacket cools the entire apparatus and complements and augments the air-cooling convection system on the interior of the apparatus. In the preferred embodiment, the coolant jacket is sized to remove energy deposited into the cavity by the rotary drive device (e.g. a 100 horsepower electric motor). However, the apparatus can be driven by a variety of motive sources, including electric motors, hydraulic motors, steam or gas turbines, and a variety of other sources, and the coolant jacket can be modified to accommodate whichever source is used. The mounting plate for the motor is designed with a variety of hole patterns to accept a range of standard motor sizes. A tensioning screw and hinge assembly is included to allow proper adjustment of the drive train by operator and maintenance personnel. The preferred embodiment of the apparatus uses a belt drive system, although direct drive, gear train, and other drive systems are useful.

The preferred apparatus includes a commercially available soft start unit for economical operation, and a commercially available overload sensing breaker to protect against damage to the motor. An analog or digital feedback control system may be connected between the drive system power consumption (such as electric motor amperage) and the inlet conveyance feedrate (for example, using a 4–20 mA control signal), to provide automatic control and continuous loading of the article into the apparatus. Proper operator training, or an automatic control system, may be needed or desired to insure that the apparatus is not overloaded during operation, startup, and shutdown, to prevent damage to the electrical and mechanical components. Other motor configurations may be designed for customer specific applications. Failure detection is designed into the apparatus to alert the operator to a problem when unanticipated foreign articles (such as tire rims, or other large solid metallic objects) are introduced into the apparatus, and the detector causes the apparatus to stop or slow in a manner that is safe and not injurious to personnel.

The apparatus and peripheral equipment can be installed on a standard commercial concrete pad (e.g. having a footprint of about twenty square feet). The preferred vertical clearance for maintenance and article handling is at least fifteen to twenty feet, although the apparatus can be operated with less headroom if facility limitations dictate. The apparatus can be lifted by crane or forklift to facilitate installation and maintenance. A lifting eye-hook is included in the spindle to facilitate maintenance, repair, and interchangeability. The weight of the spindle is designed so that it can be transported via a small truck. Acoustical treatments may be applied to the exterior surface of the apparatus for sound attenuation.

Typically, rubber tire chip (nominal 2" chip size) from a shredder is fed into the top of the apparatus with a variable speed conveyor at a nominal rate of 1,800 to 2,000 lbs/hr (U.S. Customary Units). However, the apparatus is provided with an optional and removable inlet hopper to facilitate a variety of article-handling systems and to be adaptable into a wide range of industrial settings. The exit port plane of the apparatus is designed so that a variety of article-handling systems, such as belt conveyors, pneumatic conveyors, storage boxes, bags, ducts, cyclones, magnets, or other devices can be readily integrated to accept the artical output from the exit port plane. The exit port is intentionally raised up on a platform to facilitate integration with article-handling systems.

A pair of self-aligning dual tapered thrust roller bearings are used to support the center shaft. These bearings improve the manufacturability (by decreasing the requirements for device tool facing of nominally parallel surfaces), maintainability, and interoperability of spindle assemblies between apparatuses at a location, without requiring extensive on-site alignment equipment. The bearings are protected with a custom housing that provides access for lubrication either by manual or automatic means.

Set screw detents are provided on the center shaft to receive the set screws from the inner raceway of commercially available bearings. Likewise, the center shaft is designed to receive commercially available drive sheaves, and has features such as fillets at changes in the shaft diameter, to reduce local stress concentrations. The center shaft is sized to allow a variety of motor sizes, and to minimize deflection under both axial and radial loads. The center shaft is designed to insure that under normal and extreme operating conditions no natural frequencies would be excited.

As discussed above, most crumbing technologies available in the marketplace today produce a limited range of article output sizes, and therefore offer little or no opportunity to tune the equipment to the needs of a particular market or user. The present invention can have complete spindle assemblies configured, and available on site, so that the article input and article output size can be easily modified with minimal downtime. The liner and spindle assemblies can be exchanged to facilitate size-reduction of a variety of article types, article input sizes, and article output sizes. For example, the present invention can be used to perform size reduction on one type of article (such as tires) in the morning, and converted to reduce a different type of article (such as carpet) in the afternoon.

The present invention may be used for pulverizing rubber, plastics, and a multitude of other materials. This apparatus not only can intake a larger article input size than prior devices but can produce the desired article output size with only one pass through the apparatus because the apparatus has a variable and adjustable interior design. The greatly enhanced flexibility of the present invention is useful for the size-reduction of many article types, for example, carpet pieces, glass, fiberglass, plastics and various other polymers. The possibilities are numerous because the interior parts are rapidly interchangeable and variable in dimension, and because the operating temperature is much lower than in most prior technologies.

Finally, prior technologies do not take advantage of the heterogeneity of the article being reduced. A critical aspect of the present invention is that the differences in compressibility and hardness of the various constituents of the article are used advantageously in the size-reduction. The harder constituents are used to internally shear the article and thus aid in size reduction. Furthermore, the constituents of heterogeneous article come out of the apparatus commingled, but separately. For example, rubber tire chips can be fed through the present invention and rubber—without the interstitial steel and fiber—comes out. The steel, rubber, and fiber are physically separated from one another during the size-reduction, and are commingled upon exit. The commingled materials can then be sorted from one another external to the apparatus. Prior technologies simply grind or mill the rubber or other article type without removing other constituents.

The following non-limiting examples illustrate a force analysis on the preferred embodiment of the invention and two different embodiments of the invention with different applications.

EXAMPLES

Force Analysis

Figure 13:
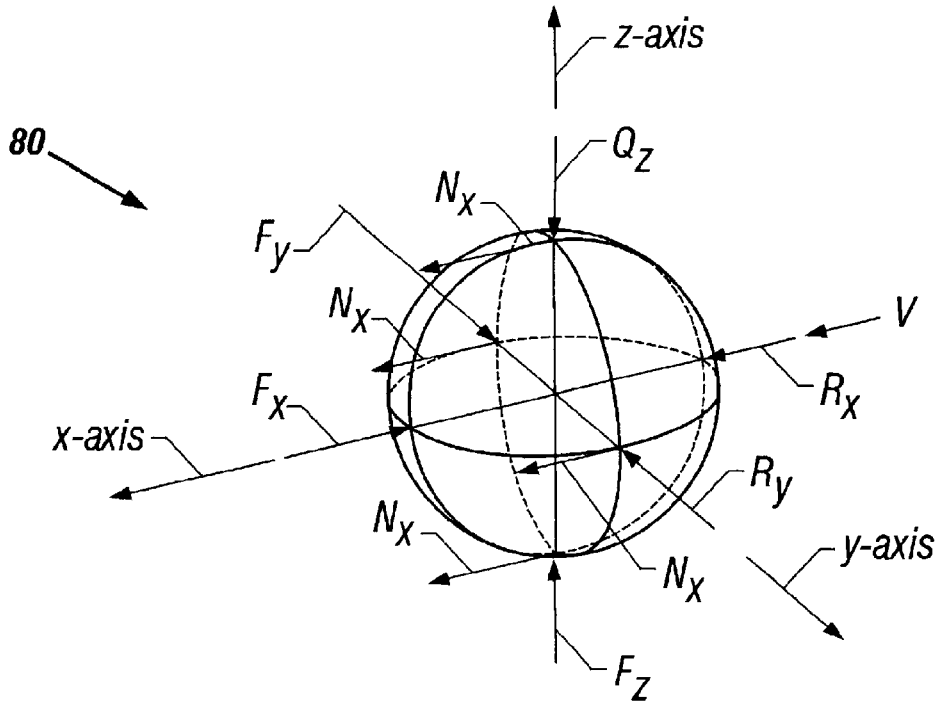
FIG. 13 is a three-dimensional representation of external forces acting upon an article processed in accordance with the present invention.
Figure 14:
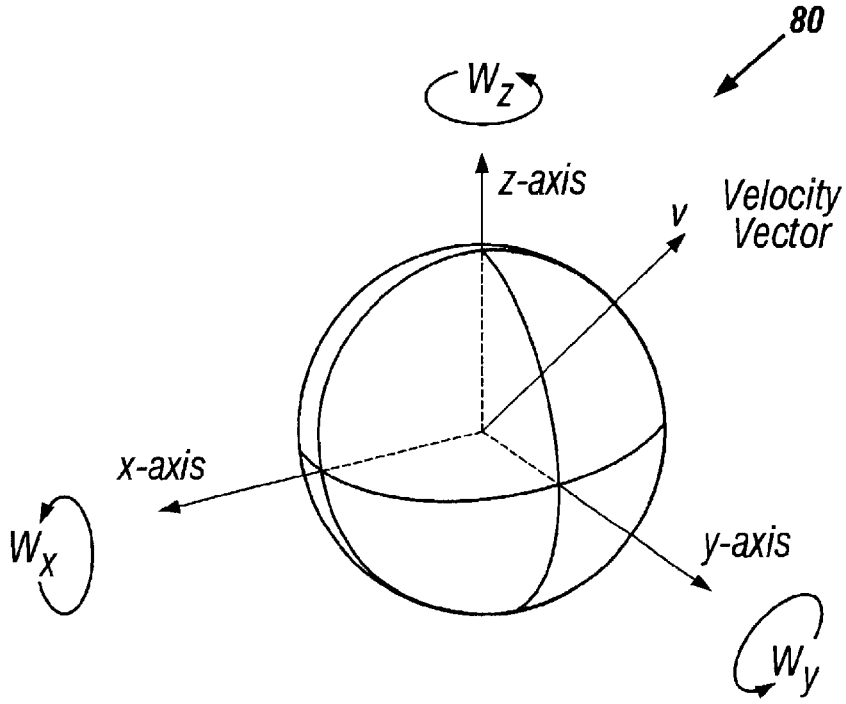
FIG. 14 is a three-dimensional representation of the rotation and displacement of an article processed in accordance with the present invention.

An analysis of the forces, which act upon the article being reduced, was performed to aid in the design of the apparatus. FIG. 13 shows the three-dimensional external forces acting upon the article-assumed to be a simple sphere. FIG. 14 shows the rotation and displacement of the article. $Q_z$ represents the combination of the gravitational force upon the article and air pressure upon the article. $F_x$ and $F_y$ are components of the impactor force upon the article. $F_y$ also includes the centrifugal force upon the article. $R_y$ is the reaction force from the liner and contact with other articles. $N_x$ is the friction force between the impactor and the article and between two articles. Angular velocity ω follows the right-hand-rule convention. Because these forces are of different values, the net effect from them is to rotate and displace the article.

The power attributable to the forces (in a typical application) is expressed as:

$$P=(F_xV_x+F_yV_y=F_zV_z)10^{-3}(\text{kw})$$

where P is the power of one cutting surface. Furthermore:

$$P=\eta P_E/Z$$

where $P_E$ is the power of the rotary drive device, η is the efficiency of transmission, and Z is the number of cutting surfaces.

$F_x$ is the main component of cutting force along the tangential direction of the rotor (N).

$V_x$ is the cutting velocity (m/s).

$F_y$ is the Y-component of cutting force (N). It does not perform any work because $V_y=0$. However, it may cause the shaft to deform and cause a strength problem with the shaft.

$V_z$ is the feeding velocity (m/s) where:

$$V_z=n\,f/1000$$

and n is the angular velocity of the rotor (rad/s). f is the feeding rate (mm/r). $F_z$ is the axial force (N), including gravitation effects and any air pressure effects. Since $F_z\,V_z$ is smaller than $F_xV_x$, the cutting force can rely upon $F_x$ and $V_x$, i.e.

$$F_x=PV_x^{-1}10^3$$

$$V_x=\pi nr/30$$

where, n is the angular velocity of the rotor, and r is the radius of the rotor. Next using the shearing slide formula:

$$F_x=\tau\cdot a\cdot b\cdot\cos(\beta-\gamma)/[\cos\varnothing\cos(\varnothing+\beta-\gamma)]$$

$$\gamma\geqq 0^0$$

where:

a is the cutting thickness (m), b is the cutting width (m),

β is the friction angle between the front surface of the impactor (or knife) and the article, and γ is the front angle of the impactor (or knife). When this angle is less than $0^0$, it cannot be used because the article is not fixed and it could move up.

Ø is the shearing angle, and

τ is the shearing stress on a shearing section.

The friction angle is:

$$\beta=\gamma+\tan^{-1}(F_z/F_x)$$

where γ can be given by a reasonable design.

The shearing angle can be obtained because the angle between the main stress direction on the front cutting surface and the largest shearing stress direction can be expressed as:

$$\varnothing+\beta-\gamma=\pi/4.$$

Figure 17:
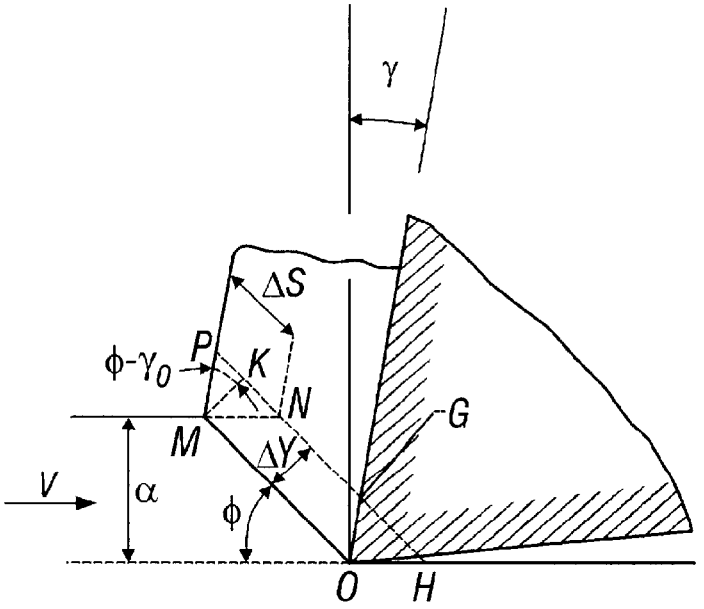
FIG. 17 is a schematic representation of the shearing slide of an article processed in accordance with the present invention.
Figure 18:
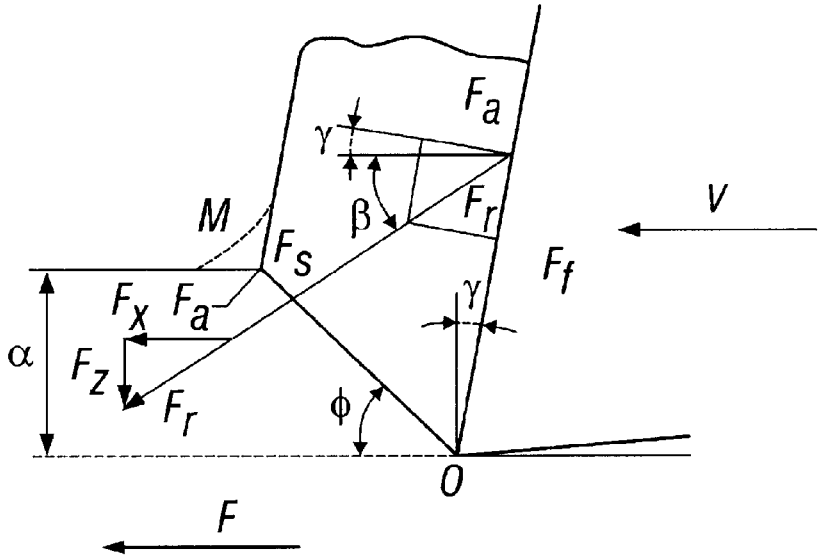
FIG. 18 is a schematic representation of the shearing angle of an article processed in accordance with the present invention.
Figure 19:
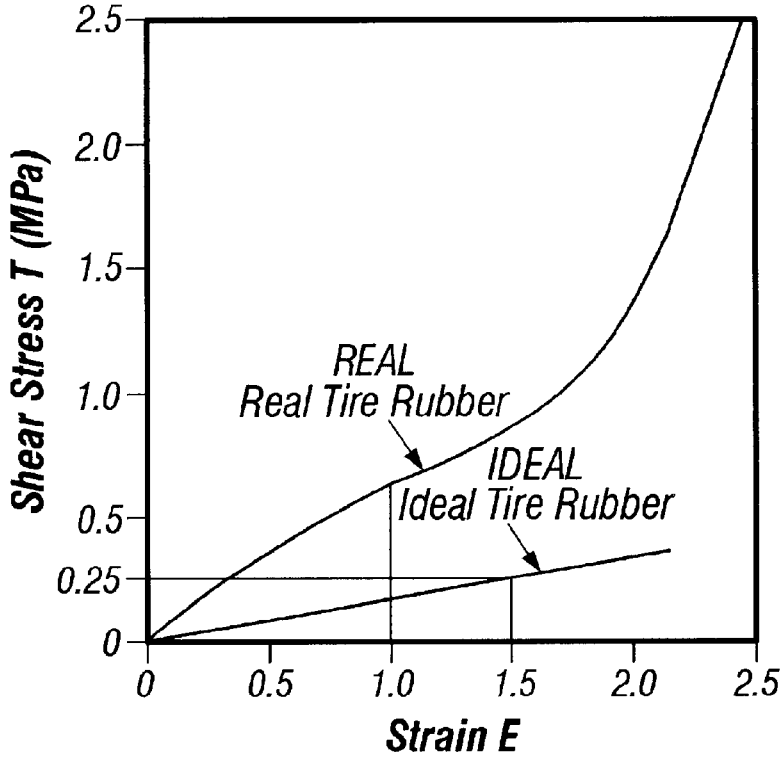
FIG. 19 is a graphical representation of shearing stress versus strain of the rubber.

See FIGS. 17 and 18. The shearing stress and strain are demonstrated in FIG. 19. In the case of rubber tire, a small shear stress easily deforms the article. The ideal stress and strain can be obtained by a sample point as shown in FIG. 19. This particular sample point represents rubber.

Figure 15:
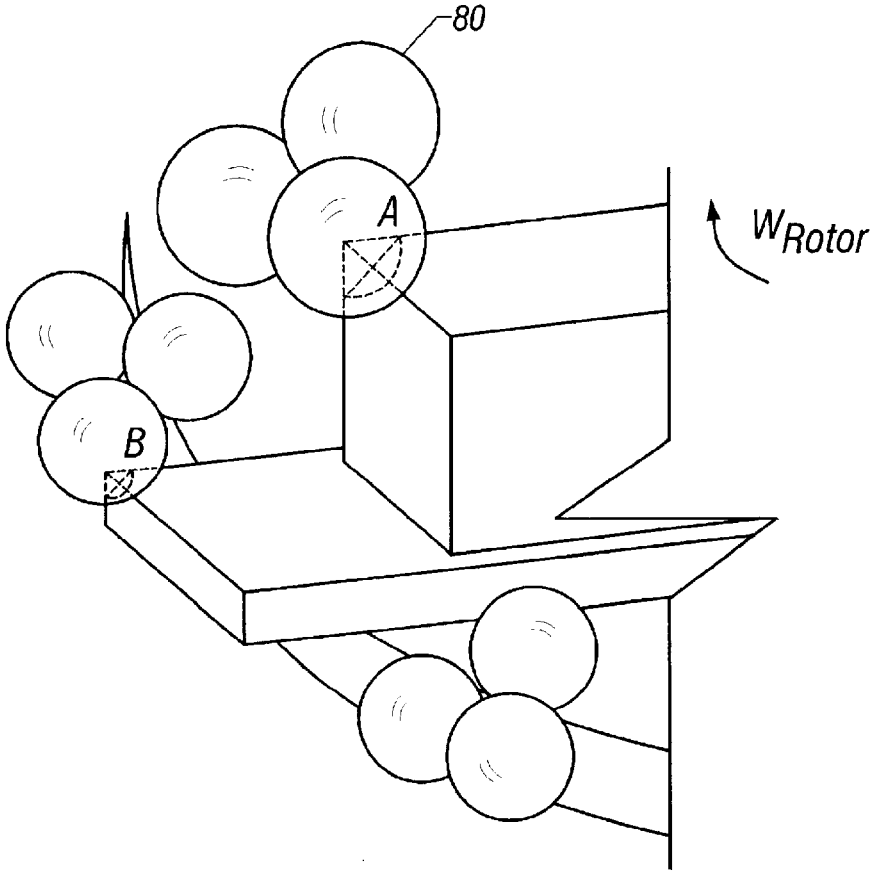
FIG. 15 is a perspective view of the wear-surfaces of the knife and impactor combination of FIG. 1.
Figure 16A:
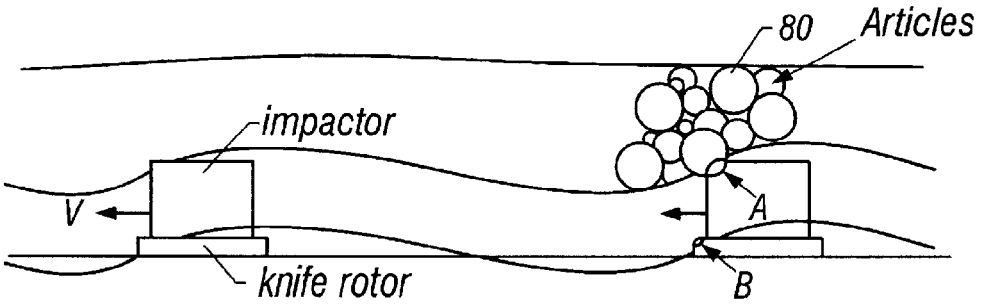
FIG. 16 is a side-view representing the path of an article processed in accordance with the present invention along a platform.
Figure 16B:
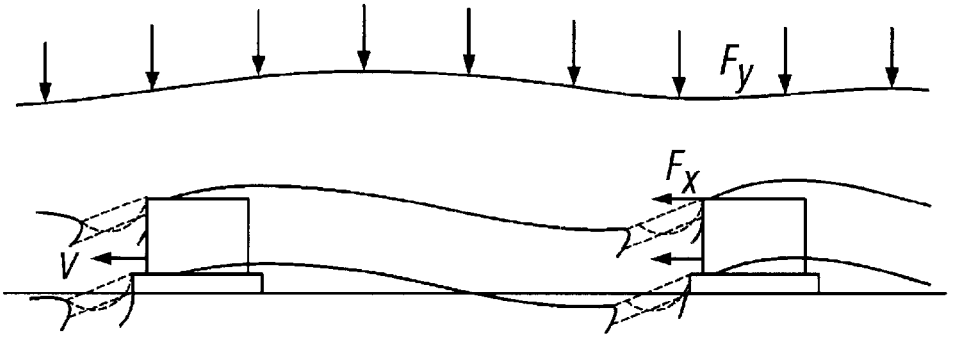

Upon viewing the most worn internal surfaces of the apparatus, the path and motion of the article was discerned to be as shown in FIG. 15 and FIG. 16. FIG. 15 shows the article as it is contacting the knife and impactor. If the rotor is rotating in the direction of ω then the impactor and knife wear out most quickly at points A and B. FIG. 16(*a*) and FIG. 16(*b*) show the article distribution along the rotor's circumference when the rotor is rotating at a high velocity. Positions A and B presented the best places to design a cutting surface.

Screen Test—Fine Configuration

For this test the apparatus was configured to have four rotors with eight impactors and eight knives mounted uniformly and distributed circumferentially around each of the rotors. A quantity of OTR (Off-The-Road) chip, nominally 2" in size, was fed into the apparatus. The chip included beadwire, and chunks of rubber. A forty pound sample of the output produced by the apparatus was evaluated using a screen classifier system to determine the distribution of sizes produced. The sample contained co-mingled rubber, fiber, and steel as separate components. Using this configuration, most of the output was between 5 and 10 mesh with nearly fifty percent being smaller than 10 mesh.

Screen Test—Hybrid Medium and Coarse Configuration

For this test, two apparatuses were configured and operated in parallel. A quantity of OTR (Off-The-Road) chip, nominally 2" in size, was fed into each apparatus. The outputs were to be combined and used for landscaping and playground surfaces. One apparatus was configured to have three rotors with eight impactors and eight knives mounted uniformly and distributed circumferentially around each of the rotors. This configuration produced virtually no output sizes larger than ⅜". The other apparatus was configured to have three rotors with four impactors and four knives mounted uniformly and distributed circumferentially around each of the rotors. This second apparatus produced a substantially larger output size distribution. Approximately eighty-five percent of the combined output size from these two apparatuses was larger than ¼" and approximately fifty percent was about 1". Very little of the output was any larger. This type of large-sized variable output was ideal for the above applications. Again, the rubber component of the output was free of any fiber and steel.

Table 1 is a comparison between standard industry tire crumbing technologies and the present invention of the number of passes through prior devices necessary to achieve the desired output, capital costs, waste by-products, and article input size that the device is capable of processing.

TABLE 1

Characteristics of Current Rubber Crumbing Technologies and the Present Invention

| Technology | Single/ Multi Pass | Capital Cost | Waste By-products | Article Input Size |
|---|---|---|---|---|
| Cracker Mill | Multi | Moderate | Steel/Fabric | ¾" |
| Cryogenic | Multi | High | Steel/Fabric | ¾" |
| Pyrolysis | Single | High | Air quality, Odor, fabric | ¾" |
| Devulcanization | Multi | High | Unknown | 40 mesh |
| Present Invention | Single | Moderate | None | 1–6" |
| Buffings | Single | Low | Casings | Whole Tires |

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A variable size-reducing apparatus for reducing the size of an article, said apparatus comprising:

a housing;

a shaft disposed within said housing;

a drive mechanism for rotating said shaft;

at least one interchangeable platform removably attachable to said shaft, at least one of said platforms having a plurality of holes through said platform for fluid transport through said platform;

a plurality of spacers removably arrangeable along the length of and covering said shaft between said platforms to space said platforms apart by predetermined distances and to protect said shaft from damage, said shaft, said platforms, and said spacers comprising one integral unit removably disposed in said housing; and a plurality of cutting surfaces located within said housing.

2. The apparatus of claim 1 wherein said drive mechanism, shaft, and platforms integrally rotate.

3. The apparatus of claim 1 wherein said platforms are removably attachable one above the other centrally and coaxially to said shaft.

4. The apparatus of claim 1 wherein said cutting surfaces comprise a plurality of changeable sharp planar surfaces removably attachable to said platforms.

5. The apparatus of claim 1 wherein said cutting surfaces comprise a plurality of angular surfaces peripheral to and separate from said platforms.

6. The apparatus of claim 1 further comprising:

an article input mechanism; and, a feedback control mechanism to monitor said drive mechanism and control said input mechanism.

7. The apparatus of claim 1 wherein said housing further comprises:

an interior wall; and an exterior wall adjacent said interior wall such that a fluid-retaining enclosure is formed;

a fluid inlet through said exterior wall;

a fluid outlet through said exterior wall, to allow the circulation of coolant fluid around said apparatus.

8. The apparatus of claim 1 further comprising a plurality of changeable propulsion surfaces removably attachable to said platforms.

9. The apparatus of claim 8 wherein said propulsion surfaces comprise a plurality of rectangular blocks.

10. The apparatus of claim 9 wherein said rectangular blocks comprise:

a top surface; and, a bottom surface, wherein said bottom surface is removably attachable to said platform, and wherein the only parallel surfaces of said blocks are said top surface and said bottom surface.

11. The apparatus of claim 1 wherein said platforms comprise a plurality of disks of varying diameters.

12. The apparatus of claim 11 wherein said disk diameters vary in size from smallest to largest from top to bottom respectively.

13. The apparatus of claim 11 wherein said disks comprise angular circumferential edges.

14. The apparatus of claim 1 further comprising a fluid handling system.

15. The apparatus of claim 14 wherein said fluid handling system comprises an oxygen-containing gas handling system.

16. The apparatus of claim 14 wherein said fluid handling system comprises:

a plurality of fluid inlets to said housing;

a plurality of fluid outlets from said housing; and a plurality of holes through said platforms.

17. The apparatus of claim 16 wherein said fluid inlets further comprise a fluid input mechanism for inputting fluid into said housing.

18. The apparatus of claim 16 wherein said fluid handling system further comprises at least one fan axially disposed within at least one of said fluid inlets.

19. The apparatus of claim 16 wherein said fluid handling system further comprises at least one fluid-flow control disposed within at least one of said fluid inlets.

20. The apparatus of claim 14 wherein said fluid handling system comprises a fan removably attached to the underside of at least one of said platforms for moving fluid through said housing.

21. The apparatus of claim 20 further comprising an article guard disposed within said fan to increase fan performance and reduce article flow into said fan.

22. A variable size-reducing apparatus for reducing the size of an article, said apparatus comprising:

a housing comprising an interior wall and an exterior wall adjacent said interior wall such that a fluid-retaining enclosure is formed;

a plurality of cutting surfaces located within said housing; and a wall surrounding said cutting surfaces and removably disposed within said housing, said wall comprising an interior surface, an exterior surface, a plurality of holes disposed in said wall, and a corresponding plurality of exterior surface enclosures to each of said holes to increase the interior surface area of said wall, to provide additional cutting surfaces, and to briefly trap the article for cutting by said cutting surfaces within said housing.

23. The apparatus of claim 22 wherein said wall comprises a plurality of rings removably and interchangeably attachable to each other.

24. A method for separating components of a heterogeneous article, said method comprising the steps of:

a) providing a heterogeneous article having components of varying hardnesses;

b) propelling the article about a housing;

c) contacting the article with surfaces within the housing;

d) compressing the article upon the contacting step; and e) ejecting harder components from softer components upon the compressing step.

25. A method for separating components and reducing size of a heterogeneous article, said method comprising the steps of:

a) providing a heterogeneous article having components of varying hardnesses to be reduced;

b) propelling the article about a housing;

c) contacting the article with surfaces in the housing;

d) compressing the article upon said contacting step;

e) ejecting harder components from softer components upon the compressing step; and, f) cutting the article with ejected harder components.

26. The method according to claim 25 further comprising the steps of cutting the compressed article with cutting surfaces within the housing; and cutting the compressed article with cutting surfaces located on a surrounding wall within the housing.

27. A method for reducing size of an article, said method comprising the steps of:

a) providing an article to be reduced;

b) propelling the article about a housing;

c) contacting the article with surfaces in the housing;

d) compressing the article upon the contacting step; and e) cutting the compressed article with cutting surfaces within the housing.

28. The method according to claim 27 further comprising the step of providing fluid into the housing.

29. The method according to claim 28 wherein said fluid providing step comprises providing an oxygen-containing gas into the housing.

30. The method according to claim 28 wherein the fluid providing step further comprises producing an interior pressure in the housing slightly below ambient air pressure.

31. The method according to claim 28 wherein the fluid providing step further comprises pulling fluid through the housing with a fan.

32. The method according to claim 28 wherein the fluid providing step further comprises controlling the fluid flow with a control mechanism.

33. The method according to claim 28 further comprising the step of maintaining the temperature of the article to a sufficient degree such that the structural integrity of the article is not compromised.

34. The method according to claim 33 wherein the temperature maintaining step comprises controlling the fluid flow.

35. The method according to claim 28 wherein the fluid providing step further comprises mixing a chemical treatment with the fluid.

36. The method according to claim 27 further comprising the step of cooling the article.

37. The method according to claim 36 wherein the cooling step comprises circulating coolant fluid around the housing.

38. A method for reducing size of an article, said method comprising the steps of:

a) providing an article to be reduced;

b) feeding the article at a controlled rate into a housing;

c) rotating a propulsion mechanism;

d) propelling the article about the housing with the propulsion mechanism;

e) cutting the article with cutting surfaces within the housing; and, f) controlling the rate of the feeding step by;

i) sensing the load of the propulsion mechanism; and ii) changing the feeding rate according to the sensed load and predetermined control values.

39. A method for reducing size of an article, said method comprising the steps of:

a) providing an article to be reduced;

b) feeding the article into a housing;

c) rotating a propulsion mechanism within the housing;

d) propelling the article about the housing with propulsion surfaces on the propulsion mechanism;

e) cutting the article with cutting surfaces within the housing;

f) providing fluid into the housing, wherein providing fluid comprises:

i) controlling the amount of fluid in the housing to retain the article within the housing for a desired amount of time; and ii) producing an interior pressure in the housing slightly below ambient air pressure;

g) varying the article output size, wherein the varying step comprises:

i) altering the number of propulsion surfaces on the propulsion mechanism;

ii) altering the number of cutting surfaces within the housing; and iii) controlling the amount of fluid flowing into the housing to retain the article within the housing for a desired amount of time; and h) controlling the article output temperature such that the structural integrity of the article is not compromised via the providing fluid step and by circulating coolant fluid around the housing.

40. The method according to claim 39 wherein the fluid providing step comprises providing an oxygen-containing gas into the housing.

* * * * *